US006572083B1

(12) United States Patent
Topping, Jr. et al.

(10) Patent No.: US 6,572,083 B1
(45) Date of Patent: Jun. 3, 2003

(54) WINCH WITH SAFE LOAD RELEASE SYSTEM

(75) Inventors: Richard A. Topping, Jr., Pittsburgh, PA (US); David B. Grapes, Pittsburgh, PA (US); Russell J. Mayhew, Carnegie, PA (US)

(73) Assignee: W. W. Patterson Company, Pittsburgh, PA (US)

( * ) Notice: Subject to any disclaimer, the term of this patent is extended or adjusted under 35 U.S.C. 154(b) by 178 days.

(21) Appl. No.: 09/651,182

(22) Filed: Aug. 30, 2000

Related U.S. Application Data

(60) Provisional application No. 60/151,404, filed on Aug. 30, 1999.

(51) Int. Cl.[7] ..... B66D 5/02
(52) U.S. Cl. ..... 254/375; 254/368; 254/376
(58) Field of Search ..... 254/357, 366, 254/368, 376, 378, 375

(56) References Cited

U.S. PATENT DOCUMENTS 3,220,701 A * 11/1965 Clausen et al. ..... 254/359
3,939,729 A * 2/1976 Brockelsby ..... 188/82.2
4,106,754 A * 8/1978 Kucher ..... 114/251
4,588,167 A * 5/1986 Finzel ..... 254/346
5,921,529 A * 7/1999 Wilson et al. ..... 242/396.9
6,116,580 A * 9/2000 Hull ..... 254/357

* cited by examiner

*Primary Examiner*—Emmanuel Marcelo
(74) *Attorney, Agent, or Firm*—Webb Ziesenheim Logsdon Orkin & Hanson, P.C.

(57) ABSTRACT

A manual winch includes a housing supporting a rotatable reel, a ratchet assembly coupled to the reel movable between an engaged and disengaged position, and a load releasing system for moving the ratchet assembly system to a disengaged position. The ratchet assembly includes a rotatable ratchet gear which is adapted to be engaged by a pivotable locking pawl. The locking pawl is pivotable into and out of engagement with the ratchet gear for moving the ratchet assembly between the engaged and disengaged position. The locking pawl is mounted on a movable base which secures the locking pawl to the housing. The load releasing system includes a linear actuator for moving the relative position of the base relative to the ratchet gear and the housing, and a separate brake for holding the reel and ratchet gear in position under a load.

15 Claims, 4 Drawing Sheets

WINCH WITH SAFE LOAD RELEASE SYSTEM

CROSS REFERENCE TO RELATED APPLICATION

This application claims the benefit of U.S. Provisional Patent Application Ser. No. 60/151,404, filed Aug. 30, 1999 entitled "Winch With Safe Load Release System" which is incorporated herein by reference.

BACKGROUND OF THE INVENTION

The present invention relates to manual winches. More specifically, the present invention relates to a load release system for a manual winch.

1. Background Information

Winches have been used in many applications. Manual winches have been widely used in barges, tow boats and the like. Examples of manual winches are sold by W. W. Patterson Company and Nashville Bridge Company. The most common type of manual winch includes a pivotable pawl, or dog, engaging a ratchet gear of a ratchet for the winch. The pawl prevents the unwinding of the reel during engagement of the pawl.

It has been known to provide a pawl releasing system for disengaging the pawl to allow for unwinding the reel, also known as paying out the load. One known load release system includes a lever for pivoting the pawl out of engagement with the associated ratchet gear. The lever is designed to rest in an over-center position when the pawl is engaged, such that the force on the pawl is also forcing the lever to a closed position due to the over-center positioning. This design prevents the load on the ratchet gear from pushing the pawl to the disengaged position. This design has several difficulties. First, in releasing the pawl, typically after a separate brake has been set, the operator must overcome the load on the pawl due to the over-centering positioning of the lever. Under heavy loads, this can be difficult. Additionally, once the lever passes the center position, the force on the pawl will now be pushing the lever to the open disengaged position. This can result in a rapid movement of the lever which can possibly be injurious to the operator. Another drawback of this design is that the relative position of the elements essentially requires the distal end of the lever to be positioned near the ground in the locked position making it difficult to reach by the operator. The inaccessibility also results in the operator pulling on the lever in an awkward, uncomfortable position. The present invention is intended to provide a manual winch with a safe load releasing system which obviates the above discussed problems of the prior art.

SUMMARY OF THE INVENTION

The objects of the present invention are achieved by a manual winch having a safe load releasing system according to the present invention. The manual winch includes a housing supporting a rotatable reel, a ratchet assembly coupled to the reel movable between an engaged and disengaged position wherein the reel is rotatable only in one direction when the ratchet assembly is in an engaged position, and a load releasing system for moving the ratchet assembly system to a disengaged position. The ratchet assembly includes a rotatable ratchet gear which is adapted to be engaged by a pivotable locking pawl. The locking pawl is pivotable into and out of engagement with the ratchet gear for moving the ratchet assembly between the engaged and disengaged position. The locking pawl is mounted on a movable base which secures the locking pawl to the housing. The load releasing system includes a linear mechanical actuator for moving the relative position of the base relative to the ratchet gear and the housing, and a separate brake for holding the reel and ratchet gear in position under a load.

In operation, when the winch is under load and the user desires to pay out or unreel a portion of the rope, the winch according to the present invention operates as follows. First, the brake, typically a hand brake, is tightened to secure the reel and ratchet gear in position before the pawl has been released. After the brake has been tightened, the actuator moves the base relative to the housing and the ratchet gear such that the associated pawl is moved relative to the ratchet gear and the housing. The movement of the base will transfer the load from the locking pawl to the tightened brake. Once the load has been fully transferred, the pawl can be easily pivoted out of engagement to the disengaged release position and the brake can be released to pay out the load as desired.

In the preferred embodiment of the present invention, the linear actuator is a manual jack screw operated by a hand wheel located near the top of the winch. The base can be easily formed as a pivoted linkage arm extending from the ratchet gear shaft with the brake being a conventional friction hand brake.

Another aspect of the present invention is that the present invention accommodates resetting if the brake is not set before transfer. A further feature of the present invention is the retrofitting of existing winches with the load release system of the present invention.

Another embodiment of the present invention provides for automatic pivoting of the pawl to a disengaged position as the base is moved. A stop may be positioned to engage the pawl as the base is lowered such that further lowering of the base will case the pawl to be pivoted away from the ratchet gear due to the engaged stop.

These and other advantages of the present invention will be clarified in the brief description of the preferred embodiments taken together with the attached figures wherein like reference numerals represent like elements throughout.

DESCRIPTION OF THE PREFERRED EMBODIMENTS

Figure 1A:
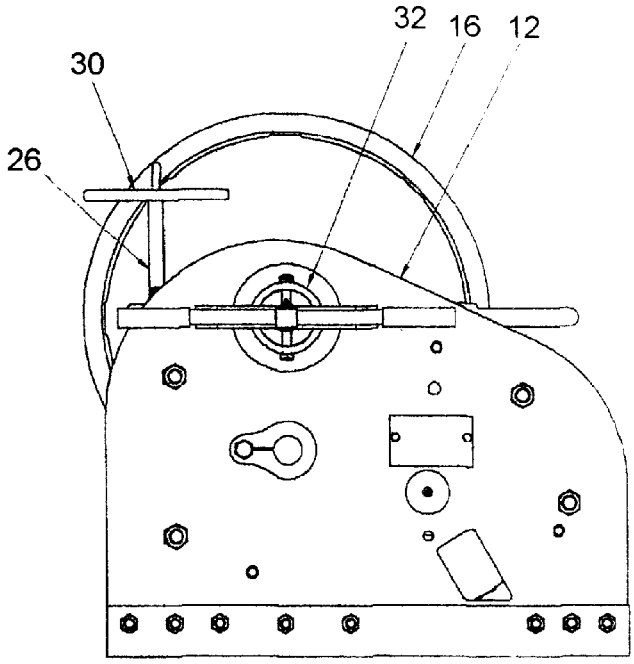
FIGS. 1*a*–1*d* illustrate the steps for releasing the load on a manual winch having a load release system according to the present invention.

FIGS. 1*a*–1*d* illustrate a manual winch 10 according to the present invention. The winch 10 includes a conventional housing 12 formed generally of a pair of vertically extending spaced plates. The housing 12 can have a base for bolting the winch 10 securely in position such as onto a deck plate, or can include a swiveling assembly for swivel positioning of the winch 10 as known in the art. The housing 12 includes a reel 14 rotatably supported therein for receiving a rope or cable wound thereon as known in the art. The reel 14 can be wound in a conventional manner, such as rotation of a hand wheel 16. Conventional gearing (not shown) is generally provided between the hand wheel 16 and the reel 14.

The winch 10 includes a ratchet assembly coupled to the reel 14 and movable between an engaged and disengaged position. When the ratchet assembly is in the engaged position, the reel 14 is rotatable in only one direction, which is the direction for reeling or loading the reel 14. The ratchet assembly includes a ratchet gear 18 mounted on a shaft 20 rotatably supported between the housing 12. As is known in the art, the shaft 20 will form a part of or be coupled to the gearing between the hand wheel 16 and the reel 14. A pivotable pawl 22 is selectively engageable with the ratchet gear 18 for moving the ratchet assembly between the engaged and disengaged position. The pawl 22 is pivotably attached to a movable base 24 which is in the form of a pair of arms extending from the shaft 20.

A linear actuator is coupled to the base 24 for moving the base 24 relative to the housing 12 and ratchet gear 18. Specifically, a jack screw 26 threadingly engages the base 24 and abuts against a stop 28 extending from the housing 12. The jack screw 26 includes a rotatable hand wheel 30 at an upper surface thereof. It will evident to those of ordinary skill in the art that rotation of the jack screw 26 through the hand wheel 30 will cause a relative movement of the base 24 by pivoting the linkage arms that form base 24 about the shaft 20.

The winch 10 additionally includes a hand actuated brake 32 associated with the shaft 20. Specifically, the hand brake 32 is a conventional type hand brake and includes a first circular plate keyed to the shaft 20 and an opposed braking plate which can be pressed against the first plate by the brake actuating handle. The hand brake 32 is a known hand brake in winch designs.

Figure 1B:
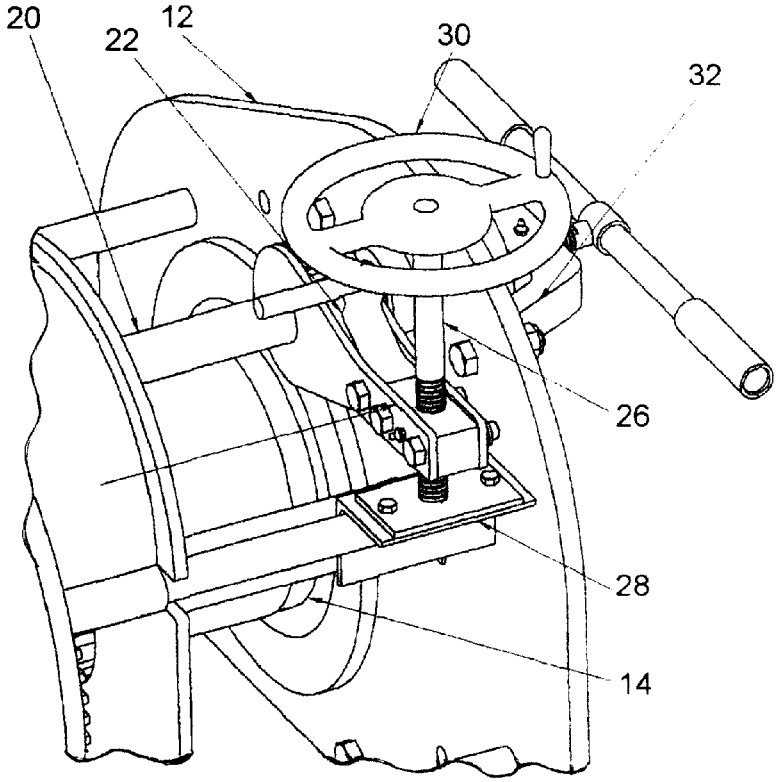
Figure 1C:
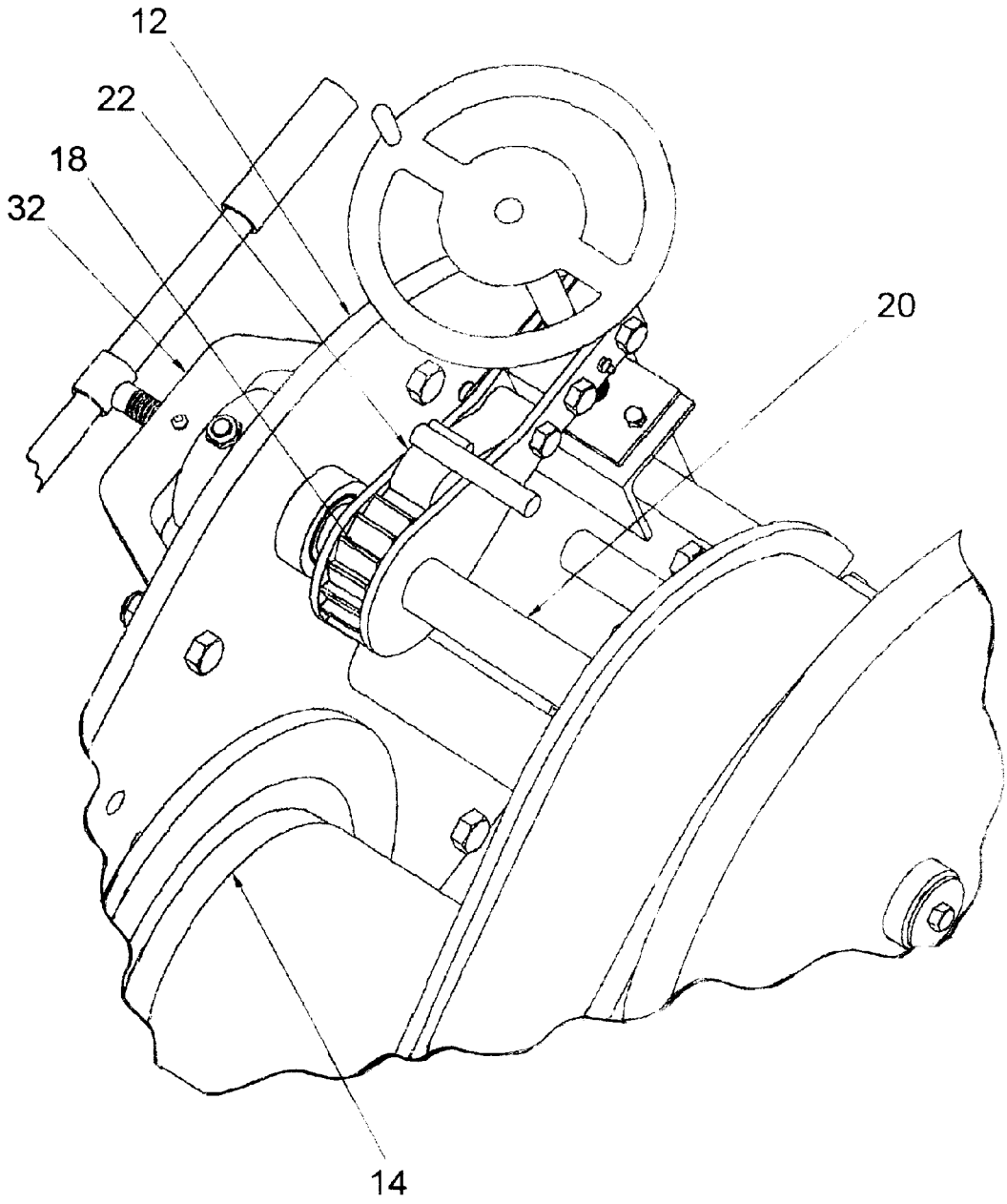
Figure 1D:
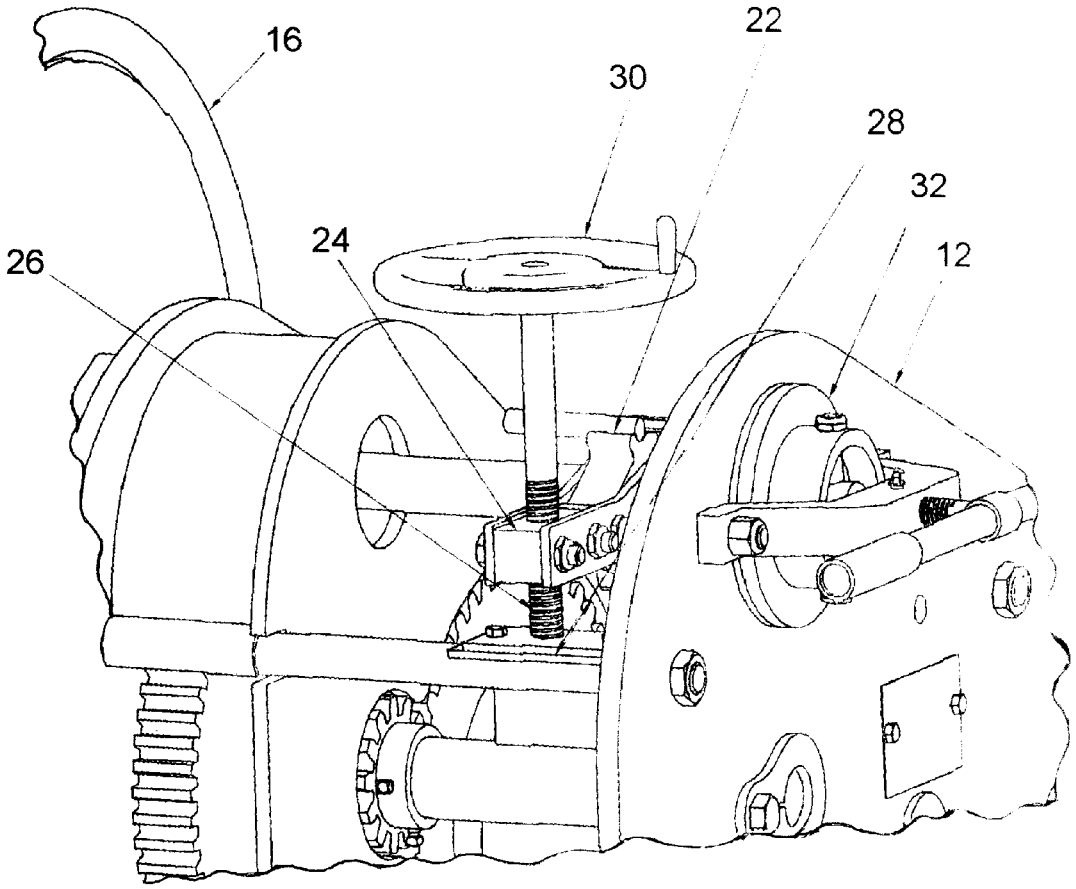

The winch 10 provides a safe load release system which is easier to operate than preexisting systems. The force required to release the present system has been found to be 80% less than the force required to release existing systems. To reiterate, the load on the winch 10 refers to a cable under tension wound on the reel 14. Releasing or paying out the load refers to allowing the cable on the reel 14 to unwind from the reel 14 due to the tension in the cable. The first step to release a load from the winch 10 is the tightening of the hand brake 32, as shown in FIG. 1*a*, which will prevent movement of the shaft 20 and associated reel 14 following disengagement of the ratchet assembly. When the brake 32 is initially tightened, the load from the reel 14 remains on the pawl 22. The second step is to move the base 24 relative to the housing 12 which will transfer the load from the pawl 22 to the hand brake 32. Specifically, as shown in FIG. 1*b*, the hand wheel 30 is rotated to turn jack screw 26 to cause the distal end of the base 24 to be lowered in the figure. The total movement necessary for transferring the load from the pawl 22 to the hand brake 32 is relatively minor. With the base 24 moved and the load removed from the associated pawl 22, the pawl 22 can be easily pivoted to a disengaged position as shown in FIG. 1*d*. A handle 34 can be secured to the pawl 22 to assist in the manual disengagement of the pawl 22. The final step in releasing the load is to selectively release the hand brake 32 to provide for a controlled release or paying out of the load. When the cable on the reel 14 has been let out (unwound) to the desired extent, the pawl 22 can be reengaged with the ratchet gear 18 by reversing the above procedure.

Another embodiment of the present invention will automatically move the pawl 22 to the disengaged position as the base 24 is lowered. A stop (not shown) is position below the pawl 22 and adapted to abut the pawl 22 as the base 24 is first lowered. Further lowering of the base 24 will lift or move the pawl 22 out of engagement with the ratchet gear 18 due to the stop.

Another aspect of the present invention is that the winch 10 accommodates resetting during releasing or paying out of the load when the brake 32 is not properly set during the payout procedure. For example, if the brake 32 is initially tightened but not sufficiently enough to hold the load from the reel 14, the present system allows this to be readily evident to the operator. In this circumstance, as the operator moves the base 24 relative the housing 12 in an attempt to transfer the load from the pawl 22 to the brake 32, the load would not be transferred due to the inappropriate setting of the brake 32. In such a circumstance, the pawl 22 would not be freely or easily pivoted to the disengaged position since it is still under load. Upon noticing that the pawl 22 is still under load such that the load has not been transferred, the operator can easily move the base 24 to the original position, properly set the brake 32 and repeat the process. This is believed to be another safety advantage of the release system of the present invention.

Figure 2:
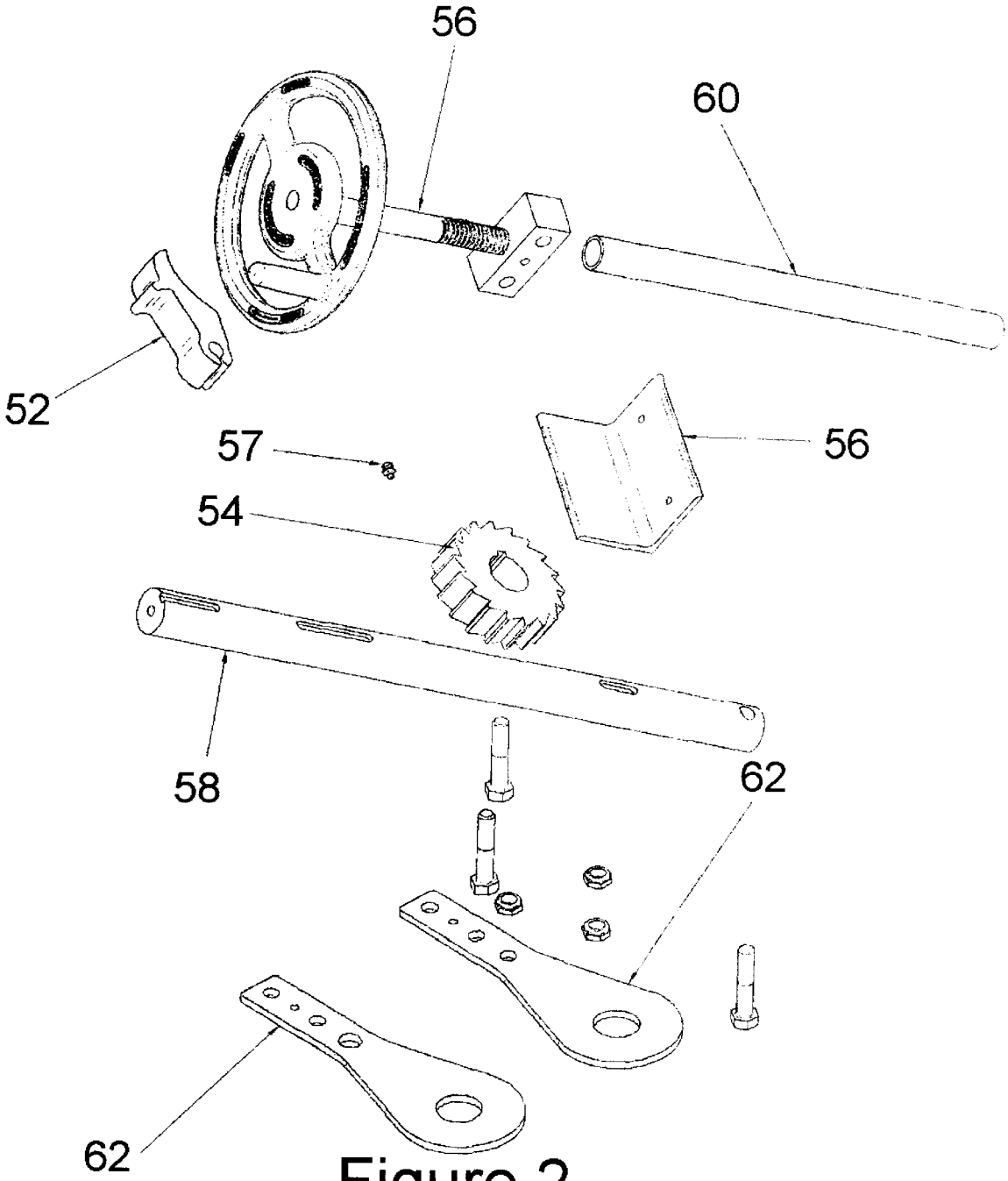
FIG. 2 illustrates a retrofitting kit for forming a winch having a load release system according to the present invention.

Another aspect of the present invention is the easy retrofitting of existing winches to form a winch 10 with the load release system according to the present invention. As shown in FIG. 2, a retrofitting kit includes a hand wheel 50 (wheel 30 of winch 10), a new locking pawl 52 (pawl 22 of the winch 10), a load release wheel 54 (gear 18), a wear plate 56 (stop 28), a key 57, a new replacement shaft 58 with keying for the load release wheel 54, a replacement separator 60 to replace the old separator which includes a cam release bar, and side release handles 62 for forming the base 24. The retrofitting is quite simple and consists of removing the old number 1 shaft and components in an existing winch as well as removing the back separator and the rear upper separator in the winch. The new separator is installed, the wear plate is welded to sit on top of the lower spreader and the new components are subsequently installed to form the winch 10 of the present invention. The winches that this can retrofit are winches such as sold by W. W. Paterson Company. This is just a representative sample of a type of retrofittable winch. Other retrofitting kits can be easily designed for other winches within the scope of the present invention.

It will be evident that various modifications may be made to the present invention without departing from the spirit and scope thereof. The described embodiment is illustrative of the present invention, but not restrictive thereof. For example, the hand brake 32 may take many forms. The key feature of the present invention is the load release mechanism for transferring the load from the engaged pawl 22 to an associated brake in whatever form. Other possible modifications include replacing the jack screw 26 with a linearly acting hydraulic piston or replacing the pivoted linkages forming the base 24 with a base structure moving in a linear fashion. All of these and other modifications will be apparent to those of ordinary skill in the art and are considered to be well within the scope of the present invention.

We claim:

1. A manual winch comprising:

a) a housing supporting a rotatable reel;

b) a ratchet assembly coupled to the reel movable between an engaged and disengaged position, wherein the reel is rotatable only in one direction when the ratchet assembly is in the engaged position wherein the ratchet assembly includes a rotatable ratchet gear which is adapted to be engaged by a pivotable locking pawl; and c) a load releasing system for moving the ratchet assembly system to the disengaged position, wherein the load releasing system includes a movable base which secures the locking pawl to the housing, a linear actuator for moving the base relative to the ratchet gear and the housing, and a separate brake for holding the reel and ratchet gear in position under a load.

2. A manual winch comprising:

a) a housing supporting a rotatable reel;

b) a ratchet assembly coupled to the reel movable between an engaged and disengaged position, wherein the reel is rotatable only in one direction when the ratchet assembly is in the engaged position wherein the ratchet assembly includes a rotatable ratchet gear which is adapted to be engaged by a pivotable locking pawl; and c) a load releasing system for moving the ratchet assembly system to the disengaged position, wherein the load releasing system includes a movable base which secures the locking pawl to the housing, a linear actuator for moving the base relative to the ratchet gear and the housing, wherein the linear actuator is a manual jack screw operated by a hand wheel located near a top of the winch and a separate brake for holding the reel and ratchet gear in position under a load.

3. The manual winch of claim 2, wherein the base is formed as a pivoted linkage arm extending from a shaft supporting the ratchet gear.

4. The manual winch of claim 3, wherein the brake is a friction hand brake.

5. The manual winch of claim 2, wherein the brake is a friction hand brake.

6. A manual winch comprising:

a) a housing supporting a rotatable reel;

b) a ratchet assembly coupled to the reel movable between an engaged and disengaged position, wherein the reel is rotatable only in one direction when the ratchet assembly is in the engaged position wherein the ratchet assembly includes a rotatable ratchet gear which is adapted to be engaged by a pivotable locking pawl; and c) a load releasing system for moving the ratchet assembly system to the disengaged position, wherein the load releasing system includes a movable base which secures the locking pawl to the housing, wherein the base is formed as a pivoted linkage arm extending from a shaft supporting the ratchet gear a linear actuator for moving the base relative to the ratchet gear and the housing, and a separate brake for holding the reel and ratchet gear in position under a load.

7. The manual winch of claim 6, wherein the hand brake is a friction hand brake.

8. A manual winch comprising:

a) a housing supporting a rotatable reel;

b) a ratchet assembly coupled to the reel movable between an engaged and disengaged position, wherein the reel is rotatable only in one direction when the ratchet assembly is in the engaged position wherein the ratchet assembly includes a rotatable ratchet gear which is adapted to be engaged by a pivotable locking pawl; and c) a load releasing system for moving the ratchet assembly system to the disengaged position, wherein the load releasing system includes a movable base which secures the locking pawl to the housing, a linear actuator for moving the base relative to the ratchet gear and the housing, and a separate brake for holding the reel and ratchet gear in position under a load, wherein the brake is a friction hand brake.

9. A load release system of a manual winch having a rachet assembly, wherein the load release system moves the rachet assembly system to the disengaged position, the load release system comprising:

a movable base for attaching a pivotable locking pawl of the rachet assembly to a housing of the manual winch;

a linear actuator for moving the base relative to a rachet gear and the housing; and a brake for holding a reel and rachet gear in to position under load.

10. A load release system of a manual winch having a rachet assembly, wherein the load release system moves the rachet assembly system to the disengaged position, the load release system comprising:

a movable base for attaching a pivotable locking pawl of the rachet assembly to a housing of the manual winch;

a linear actuator for moving the base relative to a rachet gear and the housing, wherein the linear actuator is a manual jack screw operated by a hand wheel located near the top of the winch; and a brake for holding a reel and rachet gear in to position under load.

11. The load release system of claim 10, wherein the base is formed as a pivoted linkage arm extending from a shaft supporting the ratchet gear.

12. The load release system of claim 11, wherein the brake is a friction hand brake.

13. A method of retrofitting an existing manual winch having a rachet assembly coupled to the reel movable between an engaged and a disengaged position, wherein the reel is rotatable only in one direction when the ratchet assembly is in the engaged position and wherein the rachet assembly includes a rotatable rachet gear which is adapted to be engaged by a pivotable locking pawl, the method comprising the steps of:

attaching a movable base which secures the locking pawl to the housing; and attaching a linear actuator to the housing for moving the base relative to the rachet gear and the housing.

14. A method retrofitting an existing manual winch having a rachet assembly coupled to the reel movable between an engaged and a disengaged position, wherein the reel is rotatable only in one direction when the ratchet assembly is in the engaged position and wherein the rachet assembly includes a rotatable rachet gear which is adapted to be engaged by a pivotable locking pawl, the method comprising the steps of:

attaching a movable base which secures the locking pawl to the housing; and attaching a linear actuator to the housing for moving the base relative to the rachet gear and the housing, wherein the linear actuator is a manual jack screw operated by a hand wheel located near a top of the winch.

15. The method of claim 14, wherein the base is formed as a pivoted linkage arm extending from a shaft supporting the ratchet gear.

* * * * *